US006425307B1

(12) United States Patent
Chen

(10) Patent No.: US 6,425,307 B1
(45) Date of Patent: Jul. 30, 2002

(54) SCREWDRIVER HAVING A PLURALITY OF INTERCHANGEABLE TIPS OF VARIOUS SPECIFICATIONS

(76) Inventor: Chien-Chih Chen, P.O. Box 453, Taichung (TW)

( * ) Notice: Subject to any disclaimer, the term of this patent is extended or adjusted under 35 U.S.C. 154(b) by 0 days.

(21) Appl. No.: 09/931,868

(22) Filed: Aug. 20, 2001

(51) Int. Cl.[7] ..... B25B 23/00
(52) U.S. Cl. ..... 81/439; 81/438
(58) Field of Search ..... 81/436, 437, 438, 81/439

(56) References Cited

U.S. PATENT DOCUMENTS 2,667,194 A * 1/1954 Fischer et al. ..... 81/438
3,114,401 A * 12/1963 Johnson ..... 81/438
5,481,949 A * 1/1996 Yen ..... 81/438
5,533,429 A * 7/1996 Kozak ..... 81/439
5,904,080 A * 5/1999 Anderson et al. ..... 81/439

* cited by examiner

*Primary Examiner*—Joseph J. Hail, III
*Assistant Examiner*—Joni B. Danganan
(74) *Attorney, Agent, or Firm*—Harrison & Egbert

(57) ABSTRACT

A screwdriver comprises a handle, a shank, a chuck rod, a first blade, and a second blade. The chuck rod is provided with two chuck slots opposite in location to each other and different in specification from each other. The first blade and the second blade are provided with the phillips tips of various specifications, and the cabinet or keystone tips of various specifications. The first blade and the second blade are held interchangeably by the chuck rod. The two longitudinal ends of the chuck rod are interchangeably engageable with one end of the shank.

2 Claims, 10 Drawing Sheets

SCREWDRIVER HAVING A PLURALITY OF INTERCHANGEABLE TIPS OF VARIOUS SPECIFICATIONS

BACKGROUND OF THE INVENTION

1. Field of the Invention

The present invention relates generally to a screwdriver, and more particularly to a screwdriver having a plurality of interchangeable tips of various specifications.

2. Description of Related Art

As shown in FIG. 1, a prior art screwdriver comprises a handle 12, a shank 13, and a tip 10 which is detachably fastened at one end with a chuck end of the shank 13. The tip 10 is of a specification and can be interchanged with another tip 11, as shown in FIG. 2. The tip 11 is different in specification from the tip 10. It is conceivably inconvenient to use the prior art screwdriver described above in view of the fact that the tip 10 must be kept in the tool box at the time when the tip 11 is in use, and vice versa. In addition, the user of the prior art screwdriver moves around the work site. It is therefore very inconvenient for the user of the prior art screwdriver to carry the tool box with him or her while moving from one place to another on the work site.

BRIEF SUMMARY OF THE INVENTION

The primary objective of the present invention is therefore to provide a screwdriver comprising a handle, a shank, a chuck rod, a first blade, and a second blade. The chuck rod is provided with two chuck slots different in specification from each other. The first blade and the second blade are provided with the phillips tips of various specifications and the cabinet or keystone tips of various specifications. The first blade and the second blade are held interchangeably by the chuck slots of the chuck rod. The two ends of the chuck rod are interchangeably engageable with the shank.

The features and the advantages of the present invention will be more readily understood upon a thoughtful deliberation of the following detailed description of the present invention with reference to the accompanying drawings.

DETAILED DESCRIPTION OF THE INVENTION

Figure 1:
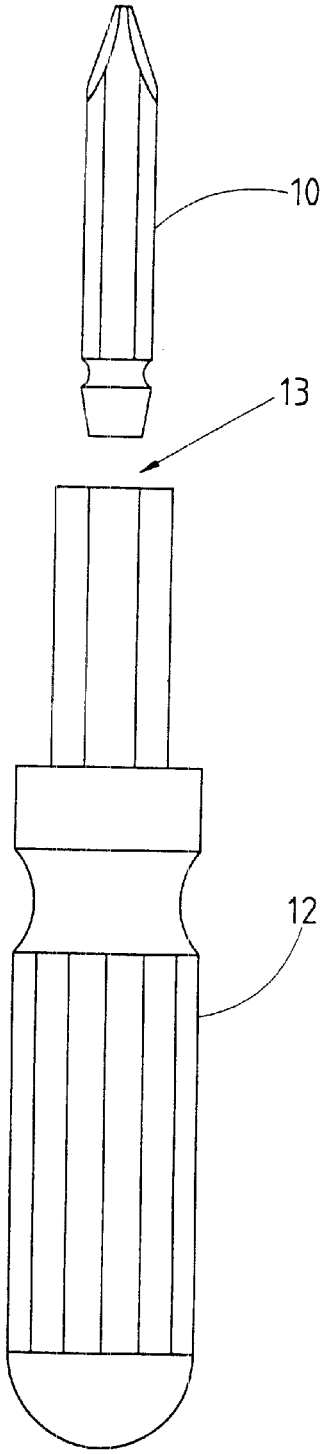
FIG.1 PRIOR ART
FIG. 1 shows a schematic plan view of a prior art screwdriver.
Figure 2:
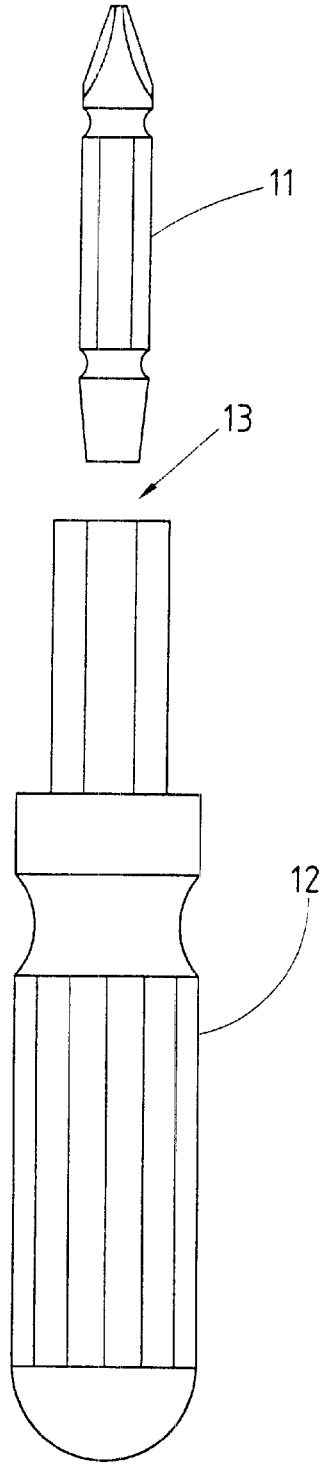
FIG.2 PRIOR ART
FIG. 2 shows another schematic plan view of the prior art screwdriver.
Figure 3:
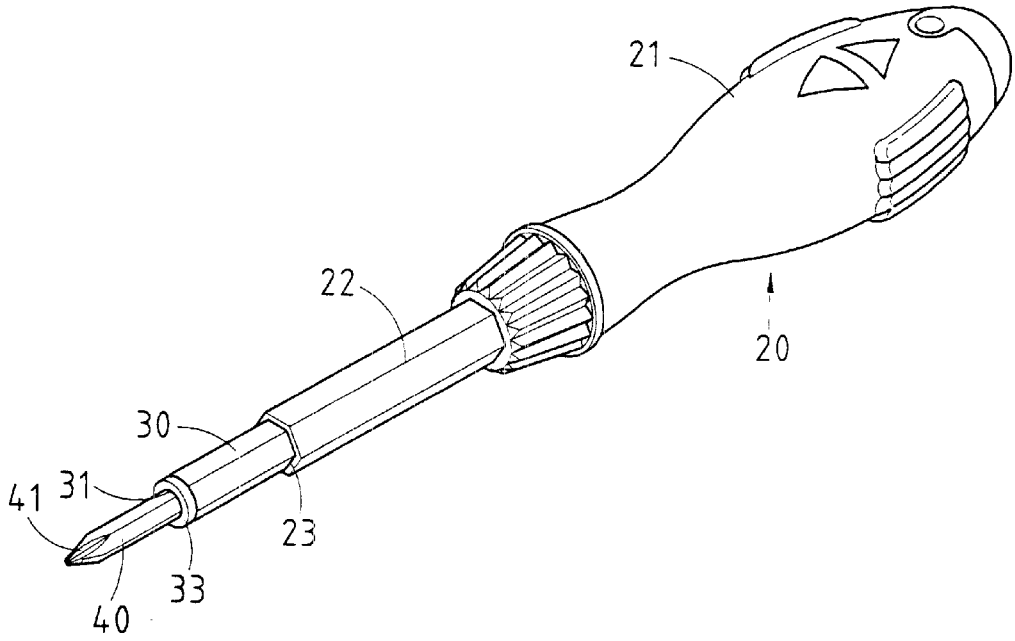
FIG. 3 shows a perspective view of the present invention.
Figure 4:
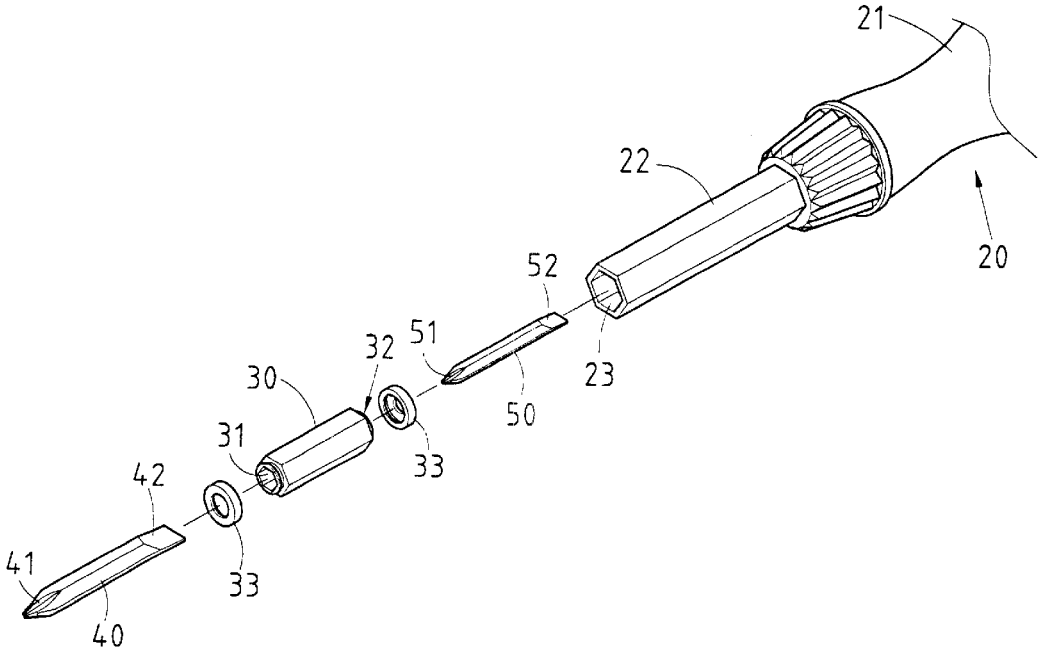
FIG. 4 shows an exploded view of the present invention.
Figure 5:
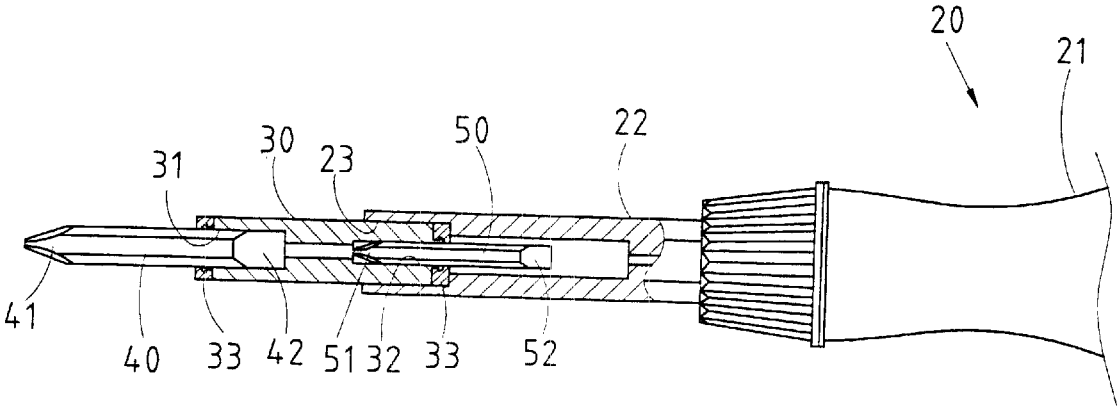
FIG. 5 shows a longitudinal sectional view of the present invention in combination.

As shown in FIGS. 3–9, a screwdriver of the present invention comprise component parts, which are described hereinafter.

A handle 20 is provided with a grip portion 21 to facilitate the holding of the handle 20 with hand.

A shank 22 is fastened at one end with the handle 20 and is provided at other end with a hexagonal chuck hole 23.

A hexagonal chuck rod 30 is held at one end in the hexagonal chuck hole 23 of the shank 22. The chuck rod 30 is provided at one end with a first blade holding slot 31, and at other end with a second blade holding slot 32 different in specification from the first blade holding slot 31. The first and the second blade holding slots 31 and 32 are provided with a lashing ring 33 of a plastic material.

A first blade 40 is held by the first blade holding slot 31 of the hexagonal chuck rod 30 in conjunction with the compressive action of the lashing ring 33. The first blade 40 is provided at one end with a phillips tip 41, and at other end with a cabinet or keystone tip 42.

A second blade 50 is held by the second blade holding slot 32 in conjunction with the compressive action of the lashing ring 33. The second blade 50 is provided at one end with a phillips tip 51, and at other end with a cabinet or keystone tip 52.

The first blade holding slot 31 is of a hexagonal construction. Accordingly, the first blade 40 is of a hexagonal construction. Similarly, the second blade holding slot 32 is of a hexagonal construction, whereas the second blade 50 is hexagonal in its cross section.

Figure 6:
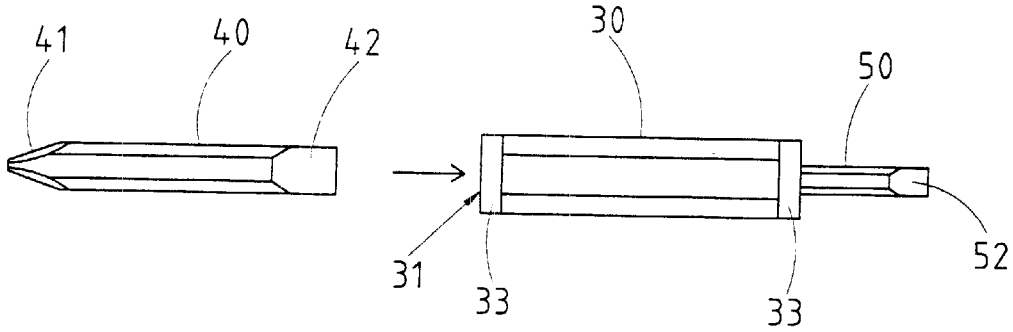
FIGS. 6–9 are Schematic views of the first blade and the second blade of the present invention at work.
Figure 7:
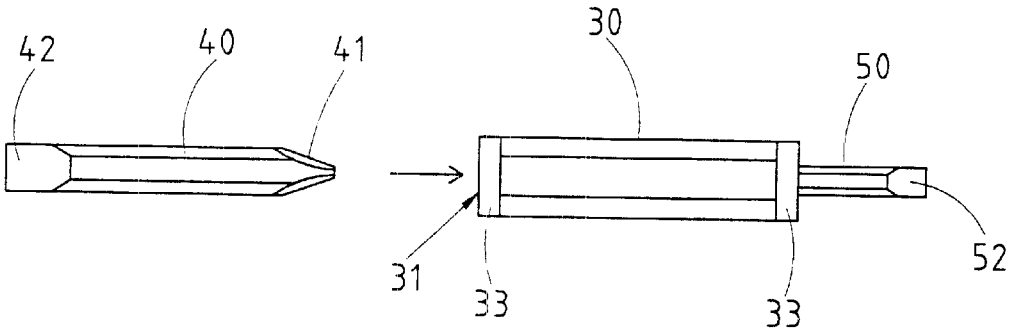
Figure 8:
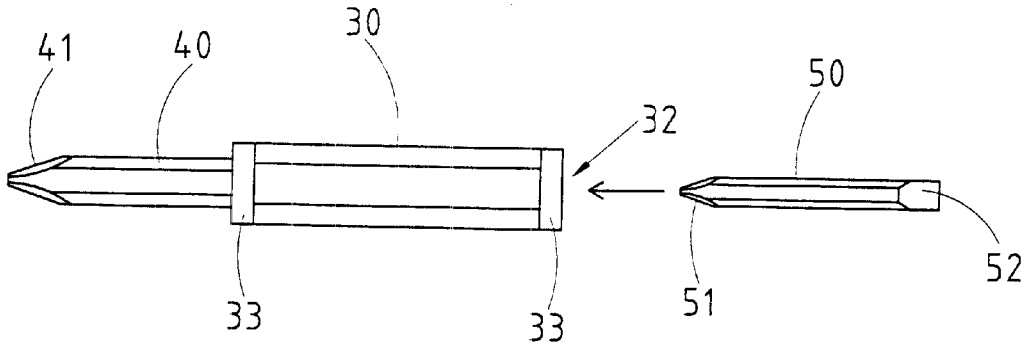
Figure 9:
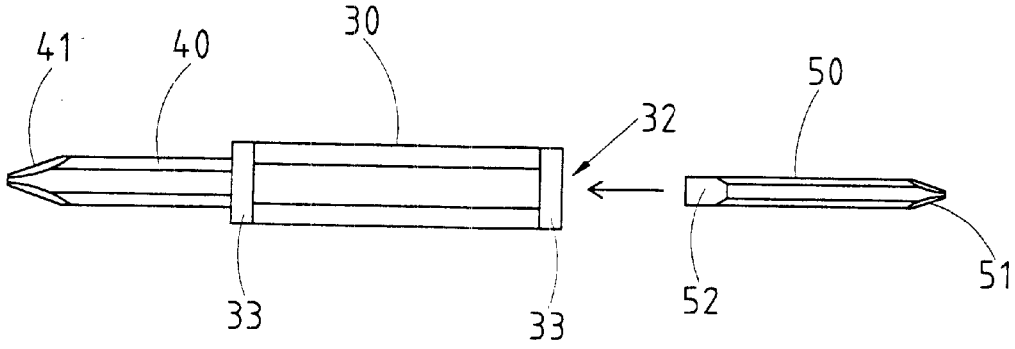

As shown in FIGS. 6 and 7, both tip ends of the first blade 40 can be held in the first blade holding slot 31 of the chuck rod 30. Similarly, both tip ends of the second blade 50 can be held in the second blade holding slot 32 of the chuck rod 30, as shown in FIGS. 8 and 9.

Figure 10:
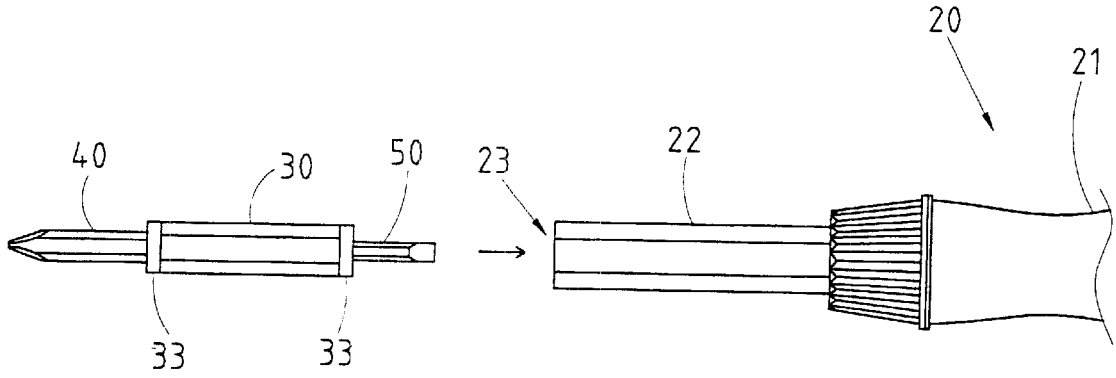
FIGS. 10–11 are schematic views of the chuck rod of the present invention at work.
Figure 11:
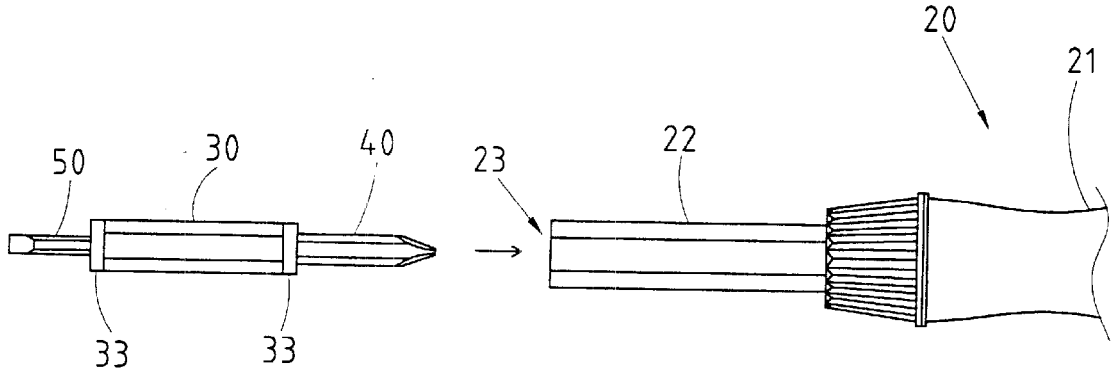

As shown in FIGS. 10 and 11, both longitudinal ends of the chuck rod 30 are engageable with the chuck hole 23 of the shank 22.

Figure 12:
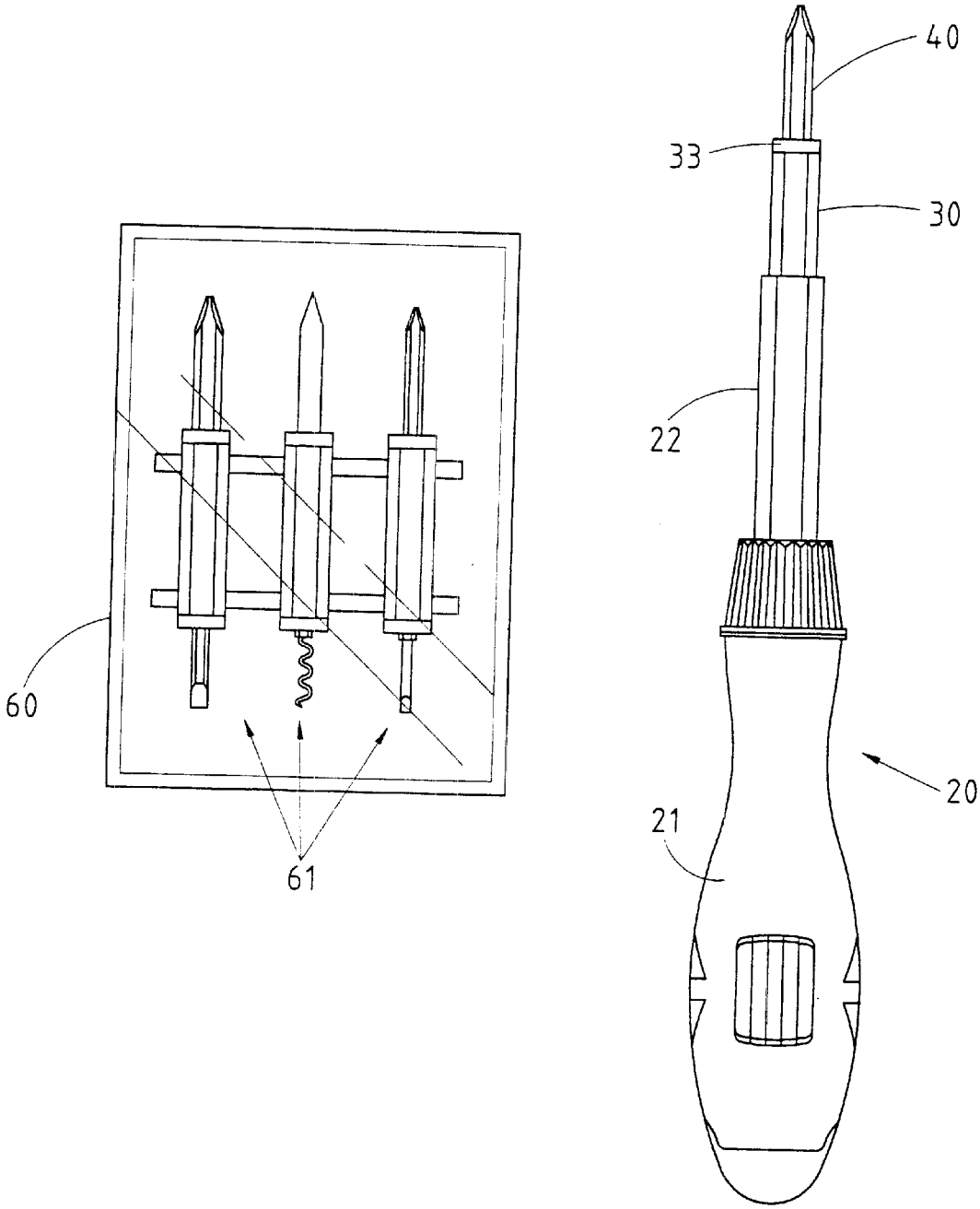
FIG. 12 shows a schematic view of the present invention comprising a plurality of blades.

As illustrated in FIG. 12, the present invention is additionally provided with a tool box 60 for keeping a plurality of blades 61 of various forms and specifications.

Figure 13:
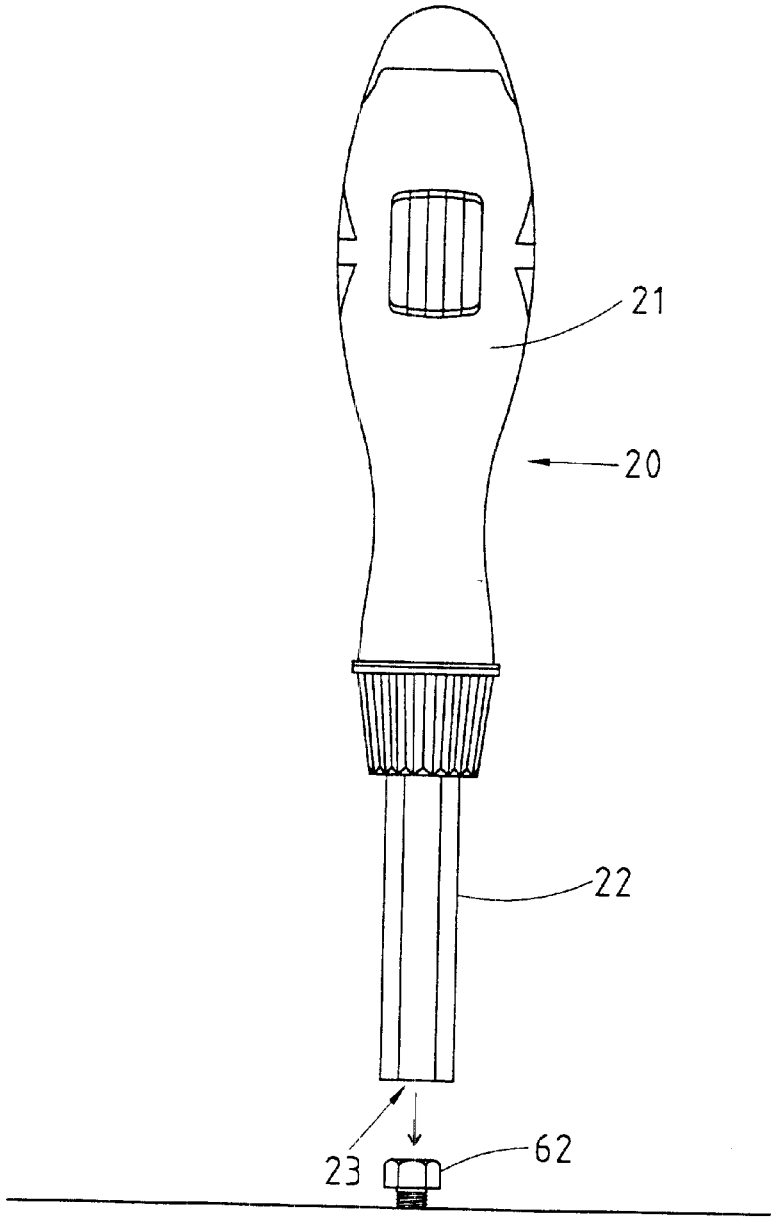
FIG. 13 shows a a schematic view of the shank of the present invention at work.

As illustrated in FIG. 13, the hexagonal chuck hole 23 of the shank 22 of the present invention may be used to fasten or unfasten a hexagonal nut 62.

In light of the above detailed description of the present invention, it is readily apparent that the screwdriver of the present invention is versatile in design and is free of the shortcomings of the prior art screwdriver.

The present invention described above is to be regarded in all respects as being merely illustrative and not restrictive. Accordingly, the present invention may be embodied in other specific forms without deviating from the spirit thereof. The present invention is therefore to be limited only by the scopes of the following claims.

I claim:

1. A screwdriver comprising:

a handle;

a shank fastened at one end to said handle, said shank having a hexagonal chuck hole at an opposite end, said shank having a first passageway opening at said hexagonal chuck hole and a second passageway opening to an end of said first passageway opposite said hexagonal chuck hole, said second passageway having a smaller interior diameter than a diameter of said first passageway, said shank having an interior shoulder positioned between said first and second passageways;

a hexagonal chuck rod having a first blade holding slot at a first end and a second blade holding slot at a second thereof, said first blade holding slot being of a different diameter than a diameter of said second blade holding slot, said second end of said hexagonal chuck rod being removably engaged through said hexagonal chuck hole and in said first passageway of said shank, said first end of said hexagonal chuck rod extending outwardly of said hexagonal chuck hole, each of said first and second ends of said hexagonal chuck rod having a plastic lashing ring affixed thereto, the lashing ring affixed to said second end of said hexagonal chuck rod being in abutment against said interior shoulder within said shank;

a first blade having a phillips tip at one end a cabinet or keystone tip at an opposite end thereof, one of said ends of said first blade removably engaged within said first blade holding slot of said hexagonal chuck rod, the other end of said first blade extending outwardly of said first blade holding slot, the lashing ring at said first end of said hexagonal chuck rod compressively contacting an exterior surface of said first blade between the ends thereof; and a second blade having a phillips tip at one end and a cabinet or keystone tip at an opposite end, one of said ends of said second blade removably engaged within said second blade holding slot of said hexagonal chuck rod, the other of said ends of said second blade extending into said second passageway of said shank, the lashing ring at said second end of said hexagonal chuck rod compressively engaging said second blade between the ends thereof, said phillips tip of said second blade having a different size than said phillips tip of said first blade, said cabinet or keystone tip of said second blade having a different size than said cabinet or keystone tip of said first blade.

2. The screwdriver of claim 1, each of said first and second blade holding slots being of a hexagonal cross-section, each of said first and second blades having a hexagonal cross-section between the respective ends thereof.

* * * * *